United States Patent [19]

Barbey

[11] 4,017,580

[45] Apr. 12, 1977

[54] PROCESS AND APPARATUS FOR MANUFACTURING NON-WOVEN WEBS OF CONTINUOUS THERMOPLASTIC FILAMENTS

[75] Inventor: Jacques Barbey, Miribel, France

[73] Assignee: Rhone-Poulenc-Textile, Paris, France

[22] Filed: June 2, 1975

[21] Appl. No.: 582,755

[30] Foreign Application Priority Data

June 10, 1974 France ..... 74.20254

[52] U.S. Cl. ..... 264/210 F; 19/156.3; 425/66; 425/455 F

[51] Int. Cl.[2] ..... D01D 5/12; D01D 7/00

[58] Field of Search ..... 19/160, 163, 155, 156.3; 28/21; 193/30; 425/66, 455 F; 264/210 F

[56] References Cited

UNITED STATES PATENTS

| | | | |
|---|---|---|---|
| 2,875,503 | 3/1959 | Frickert et al. | 19/155 X |
| 3,083,437 | 4/1963 | Davis, Jr. | 28/21 |
| 3,187,387 | 6/1965 | Schuller | 19/156.3 |
| 3,660,868 | 5/1972 | Weightman | 19/163 |
| 3,707,593 | 12/1972 | Fukada et al. | 264/210 F |

FOREIGN PATENTS OR APPLICATIONS

| | | | |
|---|---|---|---|
| 1,580,328 | 9/1969 | France | |
| 1,594,499 | 7/1970 | France | |
| 1,416,387 | 7/1965 | France | 19/156 |
| 1,113,166 | 8/1961 | Germany | 28/21 |

*Primary Examiner*—Robert D. Baldwin
*Attorney, Agent, or Firm*—Stevens, Davis, Miller & Mosher

[57] ABSTRACT

A process for the manufacture of non-woven webs of continuous filaments by extrusion, stretching, deflection and deposition of a bundle of filaments on a receiving table and executing a reciprocating movement in a direction transverse to the direction of advance of the receiving table, is disclosed. Also disclosed is an apparatus for carrying out that process, for applying a reciprocating movement to the filament deflection device, comprising first, a tube in two parts, through which the filaments travel, having a fixed part and a movable part one end of which slides in the fixed part and the other carries the deflection device, and, second, means for subjecting the movable part of the tube, held parallel to the table which receives the filaments, to a reciprocating movement.

10 Claims, 6 Drawing Figures

PROCESS AND APPARATUS FOR MANUFACTURING NON-WOVEN WEBS OF CONTINUOUS THERMOPLASTIC FILAMENTS

The present invention relates to a process for the manufacture of non-woven webs of continuous synthetic filaments and a device for carrying out the process.

It is known to manufacture non-woven webs by extruding filaments, stretching them, deflecting them onto a surface and then receiving the bundle of deflected filaments on a movable conveyor belt, the extrusion, stretching and deflection devices being fixed and only the conveyor being movable. Such processes and devices are described in French Pats. Nos. 1,582,147, 1,580,328, 1,594,499, 2,128,216, 2,134,206 and 2,166,281, and U.S. Pats. Nos. 3,576,284, 3,788,100 and 3,853,651. Depending on the desired width of the web, one or more extrusion, stretching and deflection units are used, and in the latter case they are arranged side by side, staggered or unstaggered, so that each deflector deflects onto the conveyor belt a bundle of filaments which forms a constituent portion of the web.

According to certain other processes, a deflector is not used — for example in French Pat. No. 1,311,875 and U.S. Pat. No. 3,338,992 — to separate the filaments and instead the latter are given an electrostatic charge by triboelectric contact in a suction nozzle. When the filaments leave the nozzle, they are all charged with the same polarity and therefore repel one another, and the bundle formed deposits on a movable conveyor table. It is thus necessary to have several extrusion devices side by side in order to form a web of the desired width.

Consideration has also been given to using only a single apparatus for the manufacture of a web of the desired width by interposing, between the extrusion device and the conveyor table, means which cause the formation of the final web by cross-laying of at least one elementary web. Thus, U.S. Pat. No. 3,183,557, describes a process according to which the cross-laying of the elementary web is effected by means of tables located on the conveyor and causing the deposition of the elementary web by moving from one edge to the other in a direction at right angles to the advance of the latter, i.e., at right angles to the advance of the conveyor. This process is generally known as the camel-back process. While it is usually satisfactory in the production of uniform webs, it unfortunately requires large and very bulky equipment.

According to another process, described in U.S. Pat. Nos. 2,859,506, and 3,660,868, the filaments coming from an extrusion device are seized directly, in air, at a certain distance from the extrusion device, by a fluid-fed nozzle firmly fixed to a device located above and at right angles to the receiving table and causing movement of the nozzle, by a chain mechanism, from one edge of the table to the other, during which movement the filaments are projected onto the table. In such processes, the filaments are in air between having been extruded and being deposited on the table, which results in the danger of producing a heterogeneous structure, not to mention the danger of strands breaking in the factory atmosphere, which is not free from pollution.

Other processes use fixed means located above the table, the filaments being deposited over the width of the table by means of a fluid which alternately changes the direction of movement of the bundle which falls on the table. Such points are described in French Pat. No. 1,551,846 and U.S. Pat. No. 3,460,731. However, the adjustment of pneumatic means is a delicate operation, and as a result, irregularities in the structure of the webs arise, due to variations in the flow rate of the fluid which alternately changes the direction of movement of the bundle of filaments.

The present application proposes to avoid the above-mentioned disadvantages. It relates to a process which makes it possible to obtain uniform webs, and to apparatus for their manufacture.

The subject of the present invention is a process for the manufacture of non-woven webs of continuous filaments by extrusion, stretching, deflection and deposition of the bundle of filaments on a moving table, characterized in that the filaments, travelling at their stretching speed, are guided inside a closed tube until they reach the deflection device, which is subjected to a reciprocating movement, in a direction traverse to the direction of advance of the moving receiving table, and is located above the table.

A further object of the present application is an apparatus intended to apply a reciprocating movement to the filament deflection device above the moving receiving table, in a direction transverse to the direction of advance of the table characterized in that this apparatus comprises, first, a tube in two parts, through which the filaments travel, having a fixed part intended to accompany the filaments after stretching and a movable part arranged substantially parallel to the receiving table, one end of the movable part sliding in the fixed part and the other end carrying the filament deflection device, and, second, means firmly fixed to the movable part for subjecting the movable part of the tube to a reciprocating movement.

A further subject of the present application is a modification of that apparatus, in which the movable part of the tube slides over the fixed part, the other components remaining the same.

This process allows the production of non-woven webs of any weight per square meter and any desired width.

The reciprocating movement of the deflection device permits the manufacture of a homogeneous web with minimum bulk of equipment.

For correct web formation it is desirable that during the reciprocating movement the belt preferably advances by the desired width of the "voile" (veil) in accordance with the conventional web-forming techniques, the advance of the receiving belt being at most equal to the width over which the filaments are deposited. By width of voile (veil) or width of deposition of the filaments there is understood the maximum width of the deflected bundle of filaments.

The continuous filaments are preferably filaments of synthetic polymers such as, for example, polyamides, polyesters, polyolefins and their copolymers and mixtures of polymers; the filaments can also have a heterogeneous structure such as a core/sheath or side-by-side structure, and furthermore the filaments extruded by a given spinneret or by different spinnerets can have different properties.

The implementation of the process and the mode of operation of the apparatus will be better understood with the aid of the description which follows and of the figures relating thereto, which are given by way of illustration but without implying a limitation.

Figure 1:
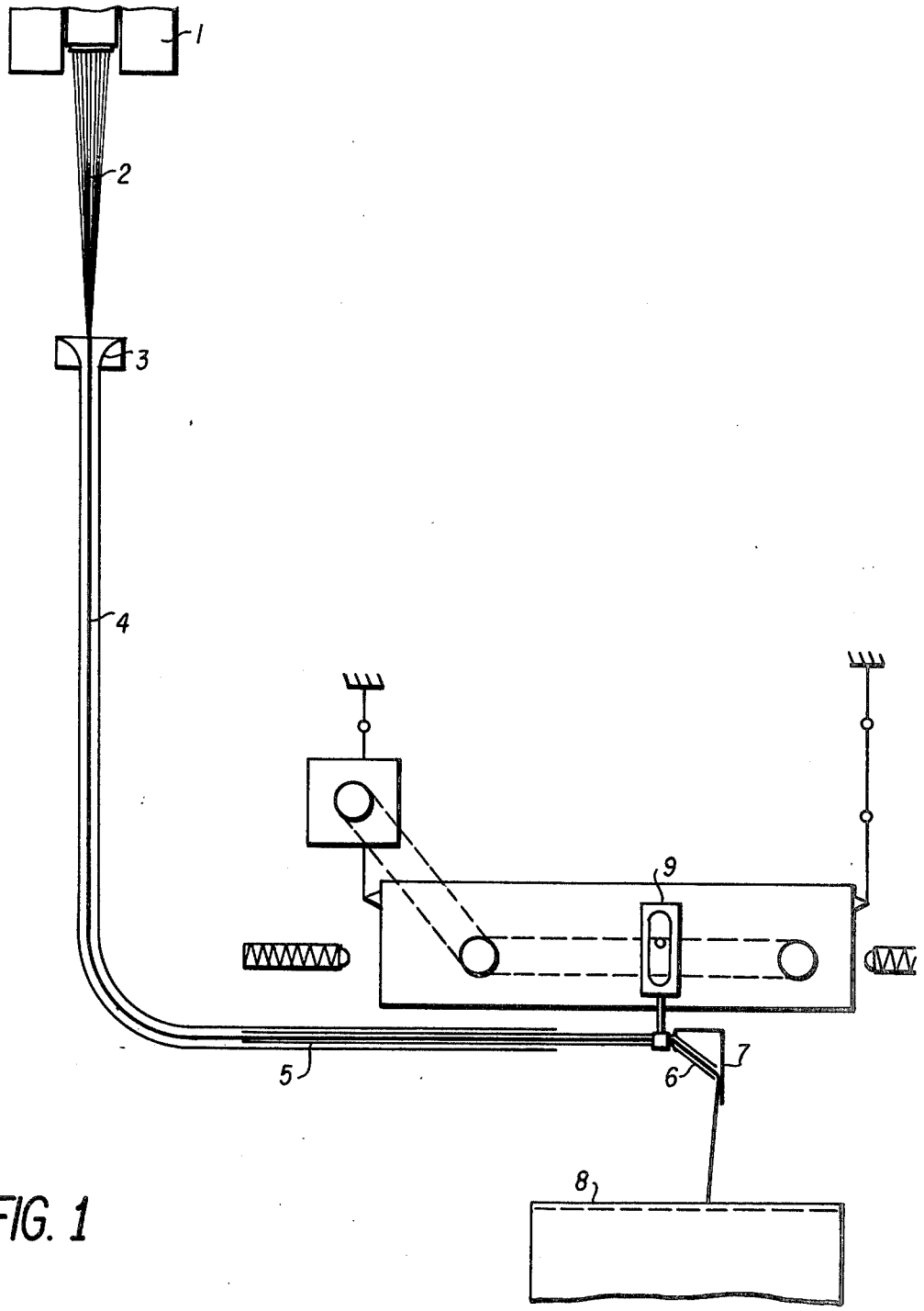
FIG. 1 is a partially schematic view of a unit for the manufacture of a non-woven web by means of the apparatus of the present application.

If reference is made to FIG. 1, one notes the spinneret block 1, the bundle of extruded filaments 2, the stretching nozzle 3, the fixed part 4 of the tube, the sliding part 5 of the tube, the pre-deflection by blow-jet 6, the deflector 7, the receiving table 8 and the drive carriage 9 for the reciprocating movement.

Figure 5:
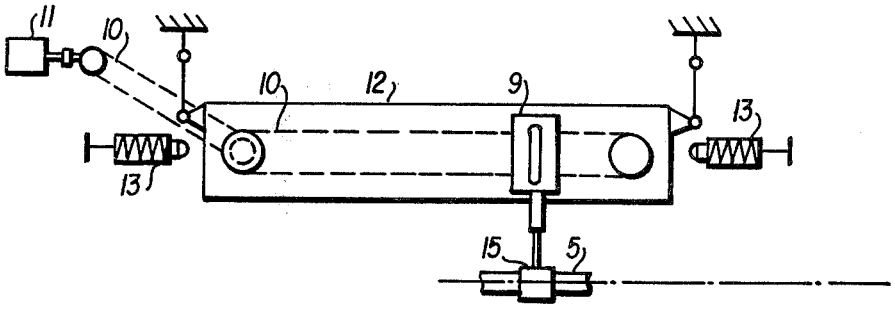
FIG. 5 is a partially schematic view of the means by which the movable part of the tube is subjected to reciprocating movement.

In FIG. 5, one sees the drive carriage 9 as well as the device which provides the reciprocating movement, comprising chains 10, a motor 11, a frame 12 suspended from an external support element which is not shown, and lateral shockabsorbers 13.

Figure 2:
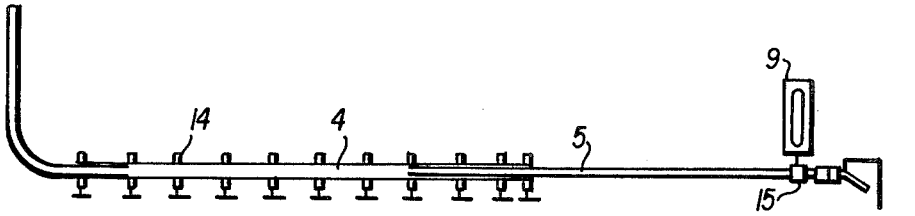
FIG. 2 is a partially schematic view of part of the manufacturing unit illustrating the sliding movement of the movable tube in the fixed tube.

In FIG. 2, showing the movable tube 5 sliding in the fixed part 4 of the tube, one sees the bearings 14 for holding the fixed tube, and the collar 15 for coupling the movable tube to the carriage 9.

Figure 3:
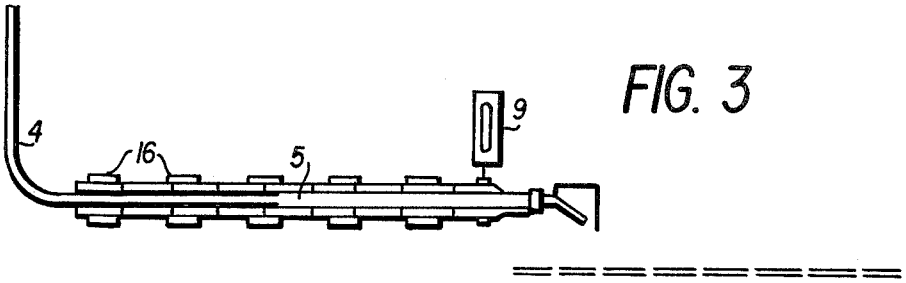
FIG. 3 is a partially schematic view of part of the manufacturing unit illustrating the sliding movement of the movable tube over the fixed tube.

In FIG. 3, showing the movable tube 5 sliding around and over the fixed tube 4, one sees fluid bearings 16.

Figure 4:
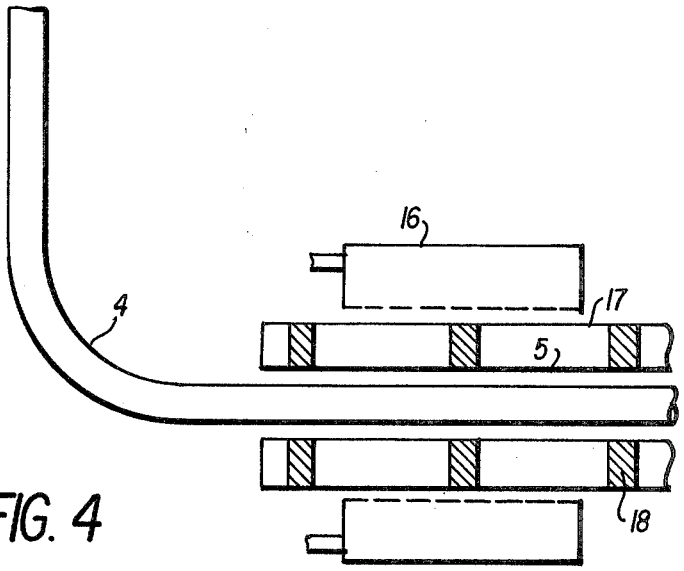
FIG. 4 is a partially schematic view of the means by which the movable tube slides over the fixed tube as shown in FIG. 3.

In FIG. 4, one sees the fixed part 4 of the tube, and the sliding part 5 firmly fixed to a second movable tube 17 (by means of ties 18), this tube itself being supported and sliding inside fluid bearings 16 fed with compressed air by means which are not shown.

Referring to the above mentioned figures, the filaments 2 coming from the head of the spinneret 1 pass through a stretching nozzle 3 such as that forming the subject of French Pat. No. 1,582,147 and U.S. Pat. No. 3,576,284. Upon issuing from this nozzle, the stretched filaments, travelling at the stretching speed, enter the fixed part 4 of the tube which has an albow, the angle of which is immaterial. Still travelling at the same speed, they then enter the movable part 5 of the tube and thereafter the blow-jet pre-deflector 6, such as that described in French Pat. No. 2,128,216. Upon issuing from this pre-deflector, the filaments encounter the deflector 7, the lower part of which is optionally subjected to a vibrating movement such as is described in French Pat. No. 2,166,281 and U.S. Pat. 3,853,651. The control system of the carriage causes the reciprocating movement of the latter and the carriage, being firmly fixed to the movable part of the tube, causes this to execute a complete cycle equivalent to one to-and-fro movement while the belt advances by an amount equal to the width of the voile or veil.

In this process, a single source of traction, namely the stretching nozzle, draws the filaments and imparts to them the requisite speed to transport them as far as the point at which they are deposited on the table.

For the sliding movement of the movable part 5 of the tube around and over the fixed part of the tube, fluid bearings are preferably used for holding and guiding the movable parts.

For the sliding movement of the movable part 5 of the tube inside the fixed tube 4, the interior of this fixed part is optionally coated with a product which provides low friction and acts as a seal, such as, for example, polytetrafluorethylene.

According to the present process, there is no acceleration at the point of reversal between the to and fro movements while, in general, acceleration at the instant of reversal is applied to avoid depositing a larger amount of material in the reversal position.

Figure 6:
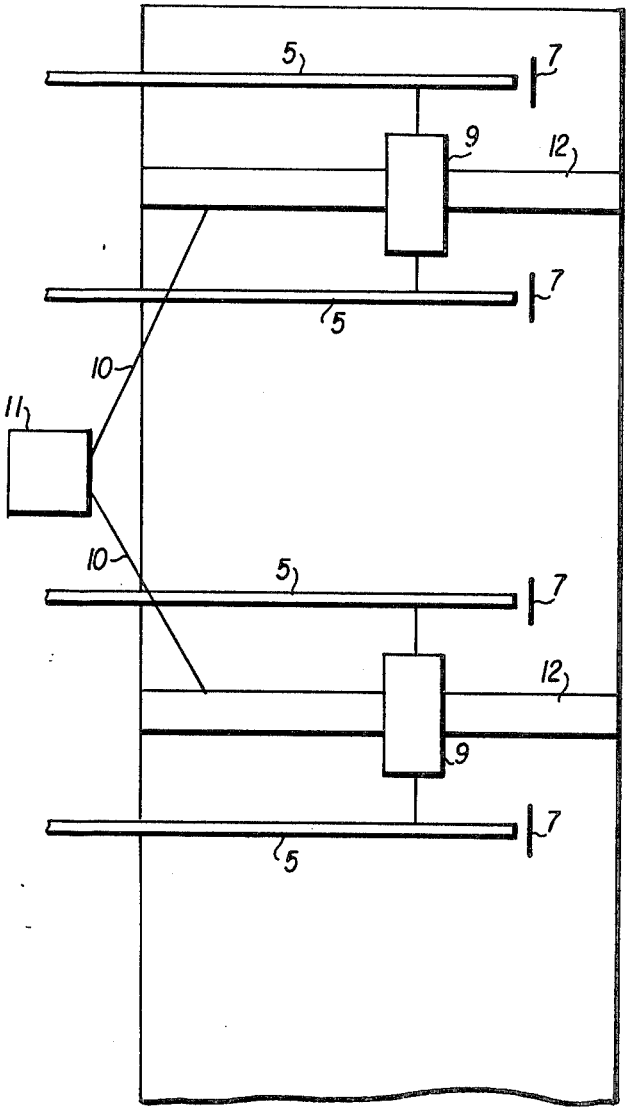
FIG. 6 is a partially schematic top view of a further embodiment of the apparatus shown in FIG. 5.

Though it is possible for the drive carriage to support only a single movable tube, the device which provides the reciprocating movement can control several tubes, as shown schematically in FIG. 6, in which one sees two devices each controlling the to-and-fro movement of two movable tubes, the filaments being produced by two extrusion stations per device. It is also possible to have several stations with at least one tube each depositing a web on the moving table, the devices being controlled by one or several motors. Where voiles (veils) issuing from several spinnerets are deposited, the final web is obtained by superposition of the constituent voiles (veils) produced from each station.

Of course it is possible to produce webs by deposition from the movable device when the latter is held fixed, in a known manner, or to arrange several devices side-by-side, or in a staggered manner so as to obtain the desired width of web.

The non-woven webs obtained can be subjected to all the usual treatments carried out, such as needle-punching, calendering, printing, application of binders and the like, and can be used, depending on their weight, for a whole range of applications, for example in the field of household linen (tablecloths, serviettes and the like), bedlinen (sheets and pillowcases), furnishings (pane curtains, window curtains, wall coverings or floor coverings), imitation leatherwork (as a base for coating) and the whole range of technical applications such as use in public works.

The examples which follow illustrate the present application without limiting it.

EXAMPLES 1 to 7

Examples 1 to 7 illustrate the possibility of manufacturing, by means of the device illustrated in FIGS. 1, 2 and 5, that is to say using a single extrusion station, webs of different weights from filaments of different kinds, the movable part of the tube sliding in the fixed part.

Table 1 shows the extrusion conditions and the conditions under which the filaments are stretched. A stretching nozzle described in French Pat. No. 1,582,147, and U.S. Pat. No. 3,576,284, a blow-jet pre-deflection described in French Pat. No. 2,128,216, and a vibrating flap deflector described in French Pat. No. 2,166,281, and U.S. Pat. No. 3,853,651, are used.

Table 2 shows the conditions of web formulation.

Table 3 shows the properties of the webs obtained.

Table 4 shows the results of checking the strength of the webs.

In these tables, the symbols denote the following:

LD = longitudinal direction of the web

TD = transverse direction or width direction of the web

TD 30 = direction at an angle of 30° to the width direction

TD 45 = direction at an angle of 45° to the width direction

TD 60 = direction at an angle of 60° to the width direction

TD 120 = direction at an angle of 120° to the width direction

TD 150 = direction at an angle of 150° to the width direction

The polyester employed in Examples 1 to 4 is a polyethylene glycol terephthalate of intrinsic viscosity 0.66. The intrinsic viscosity of the polyester is determined from the relative viscosity measured in orthochlorophenol at 25° C and is equal to the ratio of the viscosity of a solution, containing 0.5 mg of the sample in 50 $cm^3$ of the solvent, to the viscosity of the pure solvent.

The polyamide employed in Examples 5 and 6 is a polyhexamethylene adipamide having a relative viscosity of 1.36. The relative viscosity of the polyamide is the ratio of the viscosity of a solution, containing 8.4%

TABLE 1

| | EXTRUSION | | | | STRETCHING | | | |
|---|---|---|---|---|---|---|---|---|
| Example No. | Polymer | Spinneret Number of holes and ϕof each hole | Output in g/min per spinneret | Temperature of the spinneret | Distance between spinneret and stretching nozzle in meters | Fluid pressure in the nozzle, in bars | Speed of filament, in m/min | Speed of the flap. Number of strokes/min |
| 1 | polyester | 70/0.34 mm | 85 | 288° | 0.9 | 4 | 7,140 | 2,100 |
| 2 | polyester | 70/0.34 mm | 364 | 280° | 1.94 | 3.2 | 6,800 | 2,300 |
| 3 | polyester | 70/0.34 mm | 182 | 274° | 1.44 | 3.4 | 6,200 | 1,000 |
| 4 | polyester | 245/0.23 mm | 270 | 284° | 1.07 | 4.2 | 5,700 | 1,000 |
| 5 | polyamide | 105/0.34 mm | 116 | 283° | 1.07 | 3.2 | 6,520 | 1,800 |
| 6 | polyamide | 105/0.34 mm | 260 | 280° | 1.4 | 3.6 | 6,150 | 2,300 |
| 7 | polypropylene | 70/0.34 mm | 75 | 236° | 1.4 | 2 | 6,550 | 1,000 |

TABLE 2

| | | Web-forming conditions | | | | Calender | |
|---|---|---|---|---|---|---|---|
| Example No. | Total length of the tube in meters | Length of the movable tube | Speed of the carriage in m/sec | Width of the web | Width of the belt in m/min | Steam pressure in bars | Compacting pressure kg/cm² |
| 1 | 8.26 | 3.50 meters | 0.80 | 1.96 | 0.9 | 10 | 32 |
| 2 | 7.22 | " | 0.80 | 1.96 | 0.9 | 10 | 32 |
| 3 | 7.72 | " | 0.80 | 1.96 | 0.9 | 10 | 32 |
| 4 | 8.19 | " | 0.80 | 1.96 | 0.8 | 13 | 32 |
| 5 | 8.19 | " | 0.80 | 1.96 | 1.33 | 11 | 50 |
| 6 | 7.76 | " | 0.80 | 1.96 | 1.22 | 11 | 50 |
| 7 | 7.76 | " | 0.80 | 1.96 | 1.20 | 3 | 13 |

TABLE 3

| | | | Properties of the webs obtained | | | | | |
|---|---|---|---|---|---|---|---|---|
| | | | Measurement on the filaments | | Uniformity of the webs | | | |
| Example No. | Weight of the web g/m² | Gauge of filament in dtex | Tenacity g/tex | Elongation % | Average g/m² | Coefficient of variation, % | Average g/m² | Coefficient of variation, % |
| 1 | 40 | 1.7 | 31.7 | 53.5 | 43.6 | 4.4 | 42 | 4.7 |
| 2 | 200 | 8 | 32.6 | 73 | 192 | 4.3 | 189 | 4.5 |
| 3 | 100 | 4 | 33.3 | 79 | 101 | 4.3 | 102 | 4.4 |
| 4 | 150 | 1.7 | 30.3 | 90 | 144 | 3.1 | 143 | 3.6 |
| 5 | 40 | 1.7 | 29.5 | 98 | 43 | 3.8 | 42.5 | 3.7 |
| 6 | 100 | 4 | 34.4 | 91 | 100 | 4.2 | 102 | 4.5 |
| 7 | 30 | 2 | 18.7 | 171 | 27.4 | 5.8 | 27 | 5.9 |
| | | | | | Transverse Direction | | Longitudinal Direction | |

TABLE 4

| | | | Results of checks of the strength of the webs | | | | | | | | | | | | | |
|---|---|---|---|---|---|---|---|---|---|---|---|---|---|---|---|---|
| | Tearing | | Breaking load, in kilos | | | | | | | Elongation at break, in % | | | | | | |
| Example No. | LD kg | TD kg | LD | TD | TD.45 | TD.30 | TD.60 | TD.120 | TD.150 | LD | TD | TD.45 | TD.30 | TD.60 | TD.120 | TD.150 |
| 1 | calendered | | 3.3 | 3 | 3.9 | 3.5 | 3.5 | 3.3 | 3.2 | 44 | 36 | 39 | 39.4 | 41.7 | 42.9 | 40 |
| 2 | 14.7 | 13.9 | 30.9 | 36.7 | 37.2 | 37.8 | 36 | 31 | 38 | 77 | 68 | 74 | 70 | 72 | 70 | 68 |
| 3 | 11 | 9.7 | 20.7 | 26.6 | 21.8 | 23 | 21 | 21.4 | 25.4 | 76 | 71 | 76 | 70 | 78 | 76 | 72 |
| 4 | 9 | 7.6 | 29.1 | 24.2 | 21.5 | 24.2 | 23.8 | 24.9 | 78 | 69 | 74 | 69 | 76 | 76 | 71 | |
| 5 | calendered | | 1.2 | 0.9 | 1 | 0.9 | 1.05 | 1.1 | 1 | 80 | 81 | 81 | 82 | 82 | 79 | 81 |
| 6 | 17.2 | 16.8 | 26.1 | 118.9 | 24.7 | 23 | 25 | 28.7 | 24.7 | 77 | 85 | 77 | 91 | 82 | 88 | 84 |
| 7 | calendered | | 2.1 | 2.8 | 2.7 | 23 | 2 | 22 | 2.6 | 33 | 14 | 29 | 17 | 27 | 24 | 16 |

by weight of the sample in a solvent composed of 90 parts of formic acid and 10 parts of water, to the viscosity of the solvent; the measurement is carried out at 25° C.

The polypropylene employed in Example 7 has a melt $index_2$ grade of 21. This grade is determined by means of the DAVENPORT POLYTHENE GRADER apparatus, at a temperature of 230° C under a load of 2.160 kg.

The tensile strength and the elongation at break of the webs are measured by means of the INSTRON tensometer on specimens of size 5 × 10 cm (the result is the average of 10 measurements).

The tensile strength and elongation at break of the webs are measured on the same apparatus (the result is the average of 10 measurements).

The uniformity of the webs is determined by measuring the weight of 39 samples of size 5 × 5 cm, taken along a strip running in the longitudinal direction of the web (LD) or in the transverse direction of the web (TD) and calculating the corresponding coefficient of variation in each case.

The tear propagation resistance of the web is measured by means of the LHOMARGY tensometer in accordance with the method described in French Standard Specification NF-G 07055.

The webs of Examples 2, 3, 4 and 6 are needle-punched under the following conditions:

Needle-punching by means of a needle-punching machine manufactured by Etablissements ASSELIN, 3,850 needles per linear meter of board, SINGER trade mark needles, 15 × 18 × 36, 3 inch Test 06/15.

The pricking density, per square centimeter, and the depth of penetration are as follows:

| Example | Pricking density/cm² | Penetration in mm |
|---|---|---|
| 2 | 50 | 13 |
| 3 | 50 | 13 |
| 4 | 59 | 13 |
| 6 | 100 | 17 |

Webs 1, 5 and 7 are calendered after manufacture.

As may be noted on reading the results obtained, particularly those relating to the different coefficients of variation, the webs obtained are very uniform, regardless of their weight.

EXAMPLE 8

The object of the present example is to illustrate the manufacture of a web from four different extrusion stations, a motor serving to move two sections of movable tube as shown by FIG. 5, and each filament extrusion station being made as in Examples 1 to 7.

Manufacturing conditions

Nature of the polymer: polyester of intrinsic viscosity 0.66

Four spinnerets with 70 orifices each of 0.34 mm

Output in grams per minute: 126 per spinneret

Temperature of each spinneret: 280° C

Distance of each spinneret from each stretching nozzle: 1.7 meters

Pressure of air in the stretching nozzle: 2.6 bars

Speed of the filament in meters/minutes: 5,000

Speed of the vibrating part of the deflector: 2,300 vibrations/min

Length of each movable section of tube: 3.50 meters

Speed of the carriage: 0.8 meter/second

Length of the reciprocating stroke: 2.26 meters

Speed of the conveyor belt: 1.48 meters/minute

Checks carried out on the web

Theoretical weight per square meter: 190 grams

Tenacity in grams/tex of the filaments: 31.7

Coefficient of variation: 18

Elongation at break of the filaments: 54%

Coefficient of variation: 26

Average weight, transverse direction: 181 grams/m²

Average weight, longitudinal direction: 186 grams/m²

Tear (propagation) resistance under 50 kg load: 10.3

Coefficient of variation: 8

Tensile strength of the web, in kilos:

LD :34.2
TD :37
TD 45 :39.7
TD 30 :37
TD 60 :37
TD 120 :33
TD 150 :37

Elongation at break of the web, in %:

LD :66
TD :56
TD 45 :63
TD 30 :62
TD 60 :62
TD 120 :68
TD 150 :61

The final web is needle-punched with the same device as in the preceding examples.

Needle-punching density: 84 pricks/cm²

Penetration of the needles: 14 mm

The checks are carried out as in the preceding examples; the symbols have the same significance.

I claim:

1. In a process for manufacturing non-woven webs from continuous filaments by steps including extruding, stretching, deflecting and depositing a bundle of filaments on a receiving table, the improvement comprising, passing the stretched continuous filaments through a tube for guiding continuous filamentary material, said tube comprising a first immovable part which is fixed to a stretching nozzle for receiving said stretched continuous filaments and a movable second part substantially coaxial with and having one end thereof slidably mounted with respect to said first part so that said second part extends over and substantially parallel to the receiving surface of a moving receiving table, deflecting said filaments emerging from said tube down toward the receiving surface of said table by contacting said filaments with a filament deflector attached to the other end of the second part of said guiding tube, and distributing said deflected filaments in a non-woven web on the receiving surface of said moving receiving table by reciprocally moving said second part of the guiding tube in a plane which is transverse to the direction in which the receiving surface of said receiving table is simultaneously moving.

2. The process of claim 1, wherein the second part of the guiding tube and the attached deflector are moved through one complete to-and-fro reciprocation while the receiving surface is moved a distance equal to the width of the veil of filaments being deflected thereon.

3. The process of claim 1, wherein said second part is reciprocally moved at a substantially constant speed without additional acceleration at the time of reversal of direction.

4. Apparatus for manufacturing non-woven webs of continuous filaments, comprising:

a spinneret block adapted for extruding a bundle of continuous filaments, a stretching nozzle mounted below said block for longitudinally stretching continuous filaments, a tube for guiding moving continuous filamentary material, said tube comprising a first immovable part which is fixed to the stretching nozzle for receiving continuous filamentary material after stretching thereof, and a movable second part substantially coaxial with and having one end thereof slidably mounted with respect to said first part for extending substantially parallel to the surface of a receiving table, a filament deflector attached to the other end of said second part of the guiding tube for deflecting continuous filaments upon emerging from said tube, toward the surface of a receiving table, and means for reciprocally moving said movable second part of the guiding tube along the direction of its axis for continuously forming a non-woven web of continuous filaments on the receiving table.

5. The apparatus of claim 4, wherein said movable second part of the guiding tube is slidably mounted within said first part thereof.

6. The apparatus of claim 4, wherein said movable second part of the guiding tube is slidably mounted over the outside of said first part thereof.

7. The apparatus of claim 4 wherein said filament deflector is located in a plane transverse to the surface of a receiving table.

8. The apparatus of claim 4, additionally comprising a moving receiving table whose receiving surface is located below said deflector.

9. The apparatus of claim 8, wherein said second part of the guiding tube is oriented for reciprocal movement transverse to the direction of movement of said moving receiving table.

10. An apparatus according to claim 4 having a plurality of said guiding tubes wherein the movable second parts of more than one of said plurality of tubes are mounted for simultaneous movement by a single said means for reciprocally moving such second parts.

* * * * *